US006580398B2

(12) United States Patent
Breakall

(10) Patent No.: US 6,580,398 B2
(45) Date of Patent: Jun. 17, 2003

(54) LOW PROFILE ANTENNA

(75) Inventor: James K. Breakall, Port Matilda, PA (US)

(73) Assignee: Star H Corporation, Lancaster, PA (US)

( * ) Notice: Subject to any disclaimer, the term of this patent is extended or adjusted under 35 U.S.C. 154(b) by 0 days.

(21) Appl. No.: 10/029,013

(22) Filed: Oct. 25, 2001

(65) Prior Publication Data

US 2003/0080910 A1 May 1, 2003

(51) Int. Cl.[7] ..... H01Q 9/00
(52) U.S. Cl. ..... 343/751; 343/749; 343/752
(58) Field of Search ..... 343/745, 747, 343/749, 751, 753, 752, 793, 797; H01Q 9/00

(56) References Cited

U.S. PATENT DOCUMENTS

| | | | | | |
|---|---|---|---|---|---|
| 2,147,814 | A | * | 2/1939 | Hahnemann | 343/745 |
| 2,521,550 | A | | 9/1950 | Smith | 343/742 |
| 2,558,487 | A | * | 6/1951 | Hills | 343/747 |
| 2,769,169 | A | * | 10/1956 | Munzig | 343/747 |
| 3,388,400 | A | | 6/1968 | Veldhuis | 343/797 |
| 3,564,551 | A | * | 2/1971 | Mills et al. | 343/747 |
| 3,683,376 | A | * | 8/1972 | Pronovost | 343/747 |
| 3,716,867 | A | * | 2/1973 | Mayes et al. | 343/747 |
| 3,725,943 | A | * | 4/1973 | Spanos | 343/797 |
| 4,109,255 | A | | 8/1978 | Silliman | 343/853 |
| 4,155,092 | A | | 5/1979 | Blaese | 343/799 |
| 4,381,566 | A | * | 4/1983 | Kane | 343/747 |
| 4,516,127 | A | | 5/1985 | Siwiak | 343/702 |
| 4,814,777 | A | * | 3/1989 | Monser | 343/727 |
| 6,052,094 | A | | 4/2000 | Kharadly et al. | 342/770 |
| 6,356,242 | B1 | * | 3/2002 | Ploussios | 343/795 |

* cited by examiner

*Primary Examiner*—Hoanganh Le
(74) *Attorney, Agent, or Firm*—Martin Fruitman

(57) ABSTRACT

The invention is a low profile antenna array, particularly beneficial for AM broadcasting stations, which dramatically reduces the height of the antenna. The antenna array is constructed of at least two conductors oriented horizontally or sloping slightly up and extending away from a center location where they have upright sections extending above the ground plane by as little as 0.01 wavelength. The individual conductors are each approximately one-quarter wavelength long. The multiple conductors of the antenna array are each fed by impedance matching sections to achieve high individual impedances, which, when connected in parallel can be made to match any desired impedance with dimensional changes.

15 Claims, 3 Drawing Sheets

LOW PROFILE ANTENNA

BACKGROUND OF THE INVENTION

This invention deals generally with antennas and more specifically with an antenna with significantly lower height above ground than those usually available.

A single quarter wavelength vertical monopole antenna may be the classic of all antenna designs. We see it for virtually every AM broadcasting station, and we see approximations of it on almost every automobile in the rod attached to an upper surface of the automobile. Such an antenna is an unbalanced antenna, and for transmitting it must be fed against a ground plane, a relatively flat conductive surface. The impedance of such an antenna is approximately 36 ohms at resonance.

For use in AM medium wave broadcasting the quarter wavelength antenna must be 447 feet (136 meters) high at 550 kHz, and at 1600 kHz it is still 154 feet (47 meters) high. Such heights not only require towers demanding considerable design and expense, but often such high towers are restricted by local building codes or pose a danger to aircraft.

One solution to the problem of high antennas was proposed as early as 1909 by Simon Eisenstein of Kiev, Russia. This was an antenna with a single vertical conductor and top loading. For the top loading, a horizontal plane formed of multiple radial conductors is added atop the vertical section that has a height much less than a quarter wavelength. Unfortunately, however, this configuration produces an antenna with a very low impedance if the height is in the desirable range of less than 0.1 wavelength.

It would be very beneficial, particularly to broadcasters and for vehicle antenna users, to have an antenna design which has both a very low height, that is, less than 0.1 wavelength, and also could be matched to a typical 50 ohm impedance system.

SUMMARY OF THE INVENTION

The present invention is a low profile antenna configuration constructed of multiple top loaded approximately vertical upright conductors clustered together. In the preferred embodiment, in order to yield an omnidirectional pattern, the individual conductors are spaced along a small circular pattern, with each conductor being excited by only an appropriate fraction of the total signal power which would be applied to a single monopole antenna for the same application. Thus a four conductor pattern has the upright conductors spaced apart at 90 degree separation points, and for a transmitting antenna configuration, each conductor is fed one-quarter of the total power.

Another feature of the invention is that the top loading on each upright conductor is only a single conductor extending away from the cluster of upright conductors, and the length of the top loading conductors and the heights of the their ends above the ground plane can be adjusted to achieve resonance and to provide the desired impedance. For ease of construction, the upright sections and the non-vertical extension can be a continuous conductor bent to form both the upright section and the non-vertical extension. With the further use of impedance matching sections on each feed to an upright conductor, a high enough impedance can be achieved on each individual conductor feed to result in an impedance which matches the commonly used 50 ohm impedance systems when all the individual antennas are fed in parallel.

The present invention thereby furnishes low profile, very low height, antenna configurations which can match the typical signal feed cables and yield nearly uniform omnidirectional radiation fields substantially identical to the fields provided by quarter wavelength monopole antennas.

DETAILED DESCRIPTION OF THE INVENTION

Figure 1:
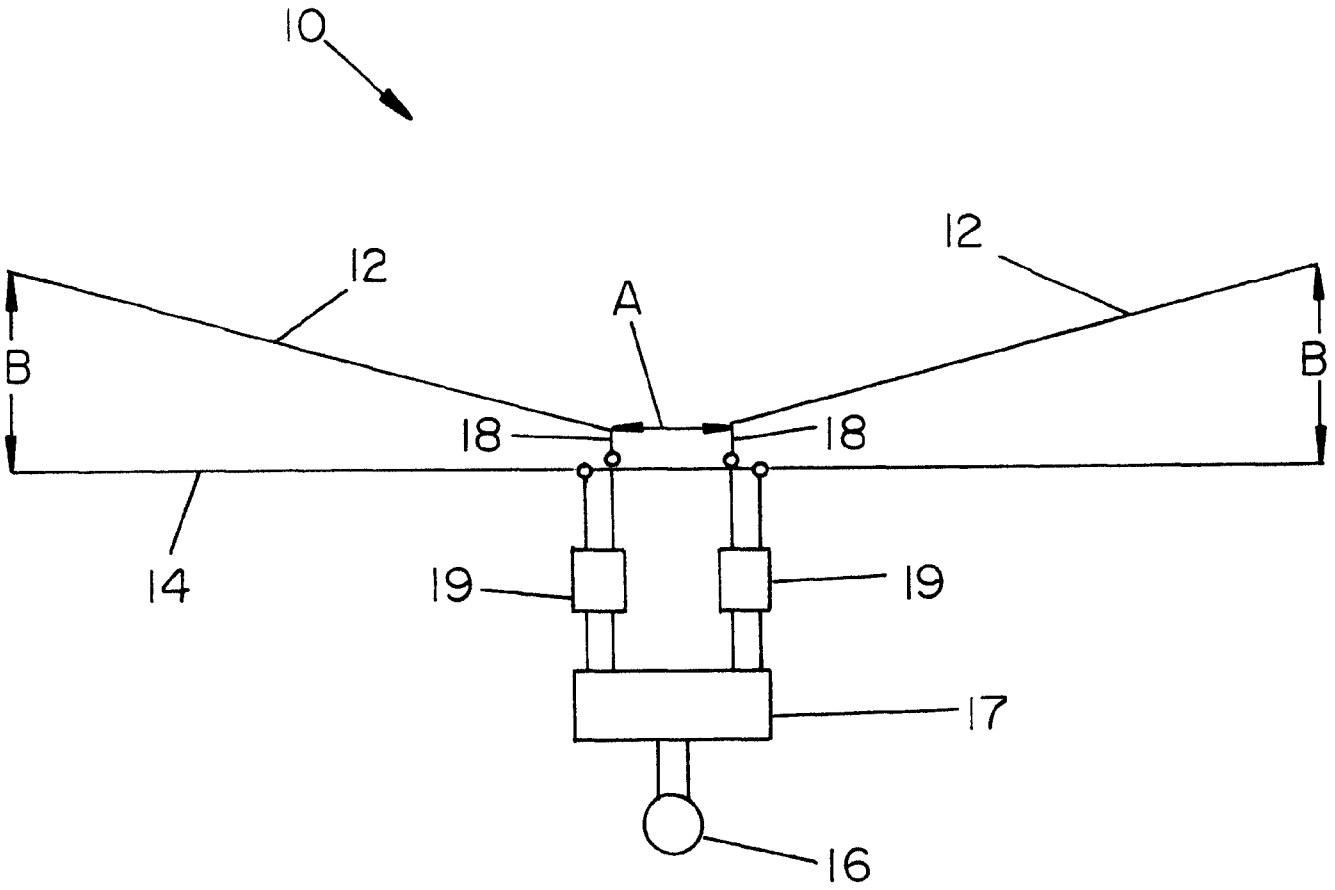
FIG. 1 is a side view schematic diagram of an antenna configuration with two sloped conductors.

FIG. 1 is a side view schematic diagram of antenna assembly 10 with two top loading sloped conductors 12 located on a diameter of a circle. The typical spacing A between upright conductors 18 is 0.20 wavelength, and dimension A must be below ½ wavelength at which distance the signals on the upright conductors would interfere. Ground plane 14 for such an antenna is also shown schematically. As is well understood by those skilled in the art, the ground plane is a conductive surface or network of conductors and can be the earth itself. It typically extends to approximately the same outer diameter as the antenna assembly, and for a ground mounted antenna for AM broadcast the diameter typically can vary between 0.50 and 1.0 wavelengths.

Each antenna conductor 12 is independently excited and connected to a common radio frequency signal device 16 through signal converter 17. In the case when radio frequency signal device 16 is a transmitter, signal converter 17 is selected to be a splitter which divides the total signal, power generated by radio frequency signal device 16 equally between all the conductors 18 with the total signal power being the equivalent of the power that would be applied to a single conventional vertical quarter wavelength monopole antenna.

In the case when radio frequency signal device 16 is a receiver, signal converter 17 is selected to be a combiner which combines the signals from all the conductors 18 and sends the combined signal to radio frequency signal device 16. That combined signal is also the equivalent of the signal received by a single conventional vertical quarter wavelength monopole antenna.

The most important characteristic of antenna assembly 10 is its low profile, its very low height above the ground plane. Thus, for the two conductor embodiment shown in FIG. 1, when matching a 50 ohm impedance the heights of upright conductors 18 are only 0.01 wavelengths, and the heights B of the ends of conductors 12 above ground plane 14 are only 0.065 wavelengths. That means that for the two conductor sloping, version of FIG. 1 the antenna with a 50 ohm impedance for a broadcast station in the middle of the AM band, at 1000 kHz, is only 64 feet high at its outer perimeter and 10 feet high at the center. Each sloped antenna conductor 12 is approximately one quarter wavelength (246 feet) long, so that the entire antenna assembly at 1000 kHz is approximately 500 feet in diameter.

However, this compares to the conventional antenna tower which is 246 feet tall and has the same ground plane diameter of approximately 500 feet diameter.

It is important to understand that the length of sloped conductors 12 and the heights B of their ends above the ground plane can be adjusted to achieve resonance and adjust impedance. Thus, antenna assembly 10 can have conductors 12 with lengths in the range between 0.15 wavelengths and 0.30 wavelengths, upright conductors 18 with lengths in the range of between 0.001 and 0.25 wavelengths, and distances B of the remote ends above ground plane 14 can be in the range of between 0.001 and 0.25 wavelengths.

Moreover, with the further use of impedance matching sections 19 between each antenna conductor 12 and its signal source 16, a high enough impedance can be achieved on each individual antenna feed to result in the commonly used 50 ohm impedance when all the individual antennas are fed in parallel. Such matching sections can be applied both to the sloping configuration shown in FIG. 1 and to an antenna assembly with the conductors 12 oriented in a single plane.

Figure 2:
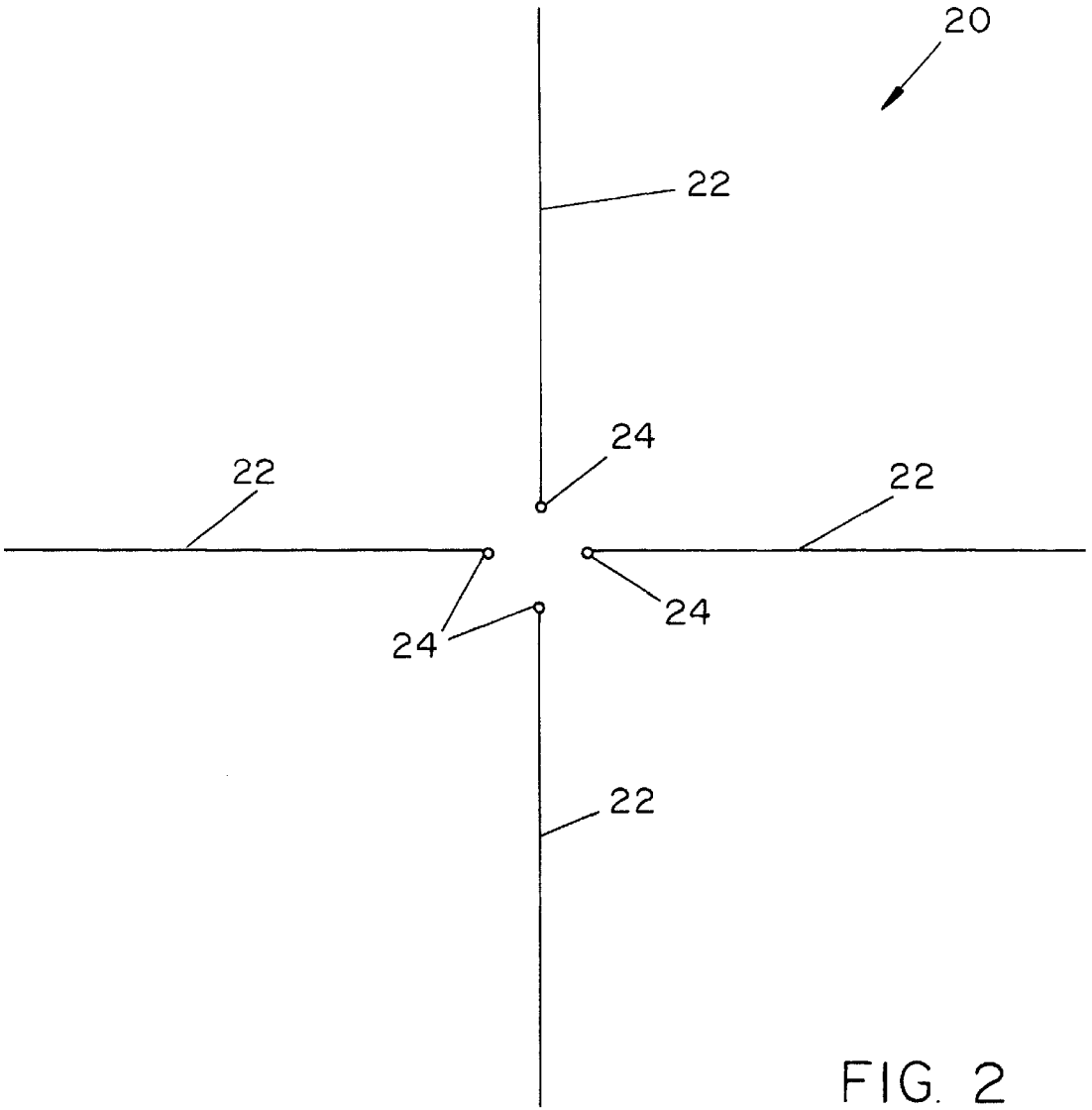
FIG. 2 is a,top view schematic diagram of an antenna configuration with four conductors.

FIG. 2 is a top view schematic diagram of antenna configuration 20 with four top loading conductors 22 extending away from each other, with the signal fed into each of the conductors 22 from an upright segment located at their inner ends 24 adjacent to the other conductors of the configuration. It should be appreciated that the benefit of the symmetry and equal spacing between conductors 22 is that they yield an omnidirectional radiation pattern, and it is not a requirement of the invention itself. As with the two conductor configuration shown in FIG. 1, each antenna conductor 22 in FIG. 2 can be connected to a radio frequency signal device (not shown) through a signal converter (not shown) and an impedance matching section (also not shown in FIG. 2). Thus, the total radio frequency power excitation of all the conductors of any of the antenna configurations of the invention can be split in the transmitting mode or combined in the receiving mode so that the total signal power exciting an antenna configuration of the invention is the equivalent of the power that would be applied to a single conventional vertical quarter wavelength monopole antenna. However, for the antenna configurations of the invention, this power can be broadcast or received by an antenna of significantly lower height.

It is important to appreciate that the slopes of the extending conductors 22, their lengths, and their heights above the ground plane are variable and can be used effectively to tune the antenna assembly. Thus, for the previously discussed station in the middle of the AM band, at 1000 kHz, the four conductor antenna of FIG. 2 when designed to match a 50 ohm impedance is only 46 feet high at its outer perimeter, and it is 10 feet high at the center. Furthermore, each sloped antenna conductor 22 is still one quarter wavelength (246 feet) long, so that the entire four conductor antenna assembly at 1000 kHz is still approximately 500 feet in diameter but only 46 feet at its maximum height.

Figure 3:
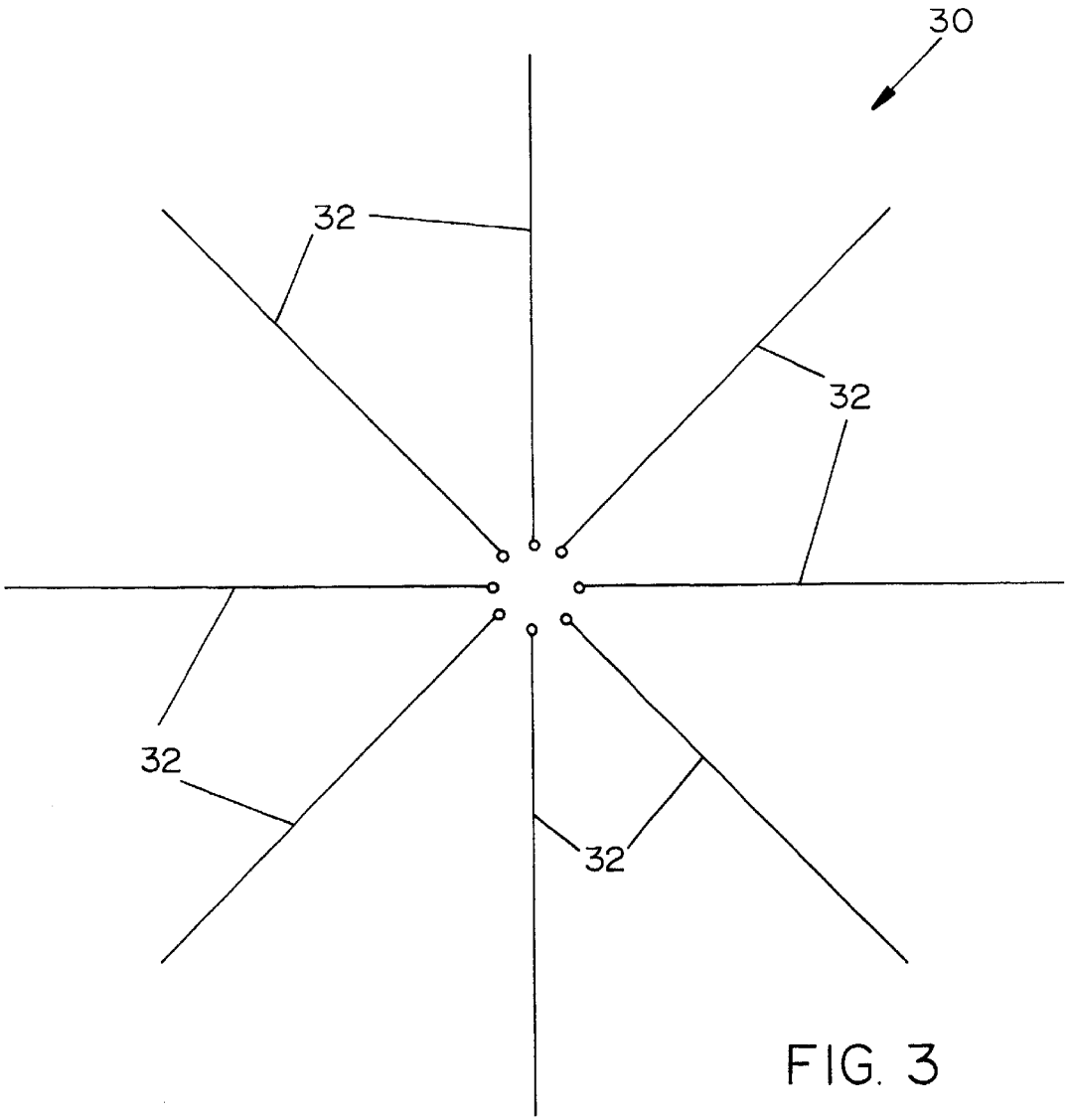
FIG. 3 is a top view schematic diagram of an antenna configuration with eight conductors.

FIG. 3 is a top view schematic diagram of an antenna configuration 30 with eight top loading conductors 32. The operation and dimensions for the eight conductor version with sloping antenna conductors 32 are the same as the 4 conductor version of FIG. 2 except for the obvious difference of splitting the power into or combining it from a greater number of paths.

However, when all the conductors 12 of the two conductor system of FIG. 1, conductors 22 of the four conductor embodiment of FIG. 2, or conductors 32 of the eight conductor embodiment of FIG. 3 are oriented horizontally, the dimensions change somewhat for the 50 ohm impedance match.

For the two, four, and eight conductor 1000 kHz antenna configurations the height of all the conductors above the ground plane is the same, at 43 feet. However, the length of each conductor of the two conductor horizontal system is 207 feet, and the length of each conductor for both the four and eight conductor systems is 185 feet.

It is also interesting to note that for a cellular antenna at 850 MHz, the four and eight conductor antennas of FIG. 2 and FIG. 3 become almost flush with the ground plane, with a center height of 0.14 inch, an outside height of 0.65 inch, and a total diameter of only approximately 7 inches.

The antenna design of the invention thus yields a very practical antenna, not only for low frequency AM broadcasting transmitters, but also for high frequency wireless communication.

It is to be understood that the form of this invention as shown is merely a preferred embodiment. Various changes may be made in the function and arrangement of parts; equivalent means may be substituted for those illustrated and described; and certain features may be used independently from others without departing from the spirit and scope of the invention as defined in the following claims.

For example, the antenna configurations of the invention can be used for any frequency, since the dimensions of the design are specified in wavelength, and the antennas of the invention can also be used in systems with any impedance with suitable adjustment of dimensions. Furthermore the conductors need not be located on exact radii of circles, as is shown in the FIGURES for convenience of drawing.

What is claimed as new and for which Letters Patent of the United States are desired to be secured is:

1. An antenna comprising:

at least two separated upright conductors each independently excited by a common signal, with the common signal equally divided among the upright conductors, with each of the upright conductors extending from adjacent to a ground plane of the antenna to a point of common height above the ground plane, and with each upright conductor having a top loading structure of a conductor for impedance adjustment, with the top loading structure attached to its upright conductor at the point of the common height, and with the top loading structure extending away from the other upright conductors in a single horizontal plane, and all the top loading structures having a common length.

2. The antenna of claim 1 wherein the antenna is installed with the ground plane having a diameter in the range of between 0.50 and 1.0 wavelengths of the frequency for which the antenna is used.

3. The antenna of claim 1 further including an impedance matching section connected to each upright conductor to match the antenna to an active radio frequency device.

4. The antenna of claim 1 further including an impedance matching section connected to each upright conductor to match the antenna to an active radio frequency signal device to which all the antenna upright conductors are connected in parallel.

5. The antenna of claim 4 further including a signal converter connected to all the upright conductors to provide separate power signal paths for each upright conductor.

6. The antenna of claim 1 wherein the common height of the upright conductors is in the range of between 0.001 and 0.25 wavelengths of the frequency for which the antenna is used.

7. The antenna of claim 1 wherein the common length of the top loading structures is in the range of between 0.15 and 0.30 wavelengths of the frequency for which the antenna is used.

8. An antenna comprising:

at least two separated conductors each independently excited by a common signal source, with each of the conductors having an upright section extending from adjacent to a ground plane of the antenna to a point of common height above the ground plane, with each upright section having top loading structure of a conductor for impedance adjustment, with the top loading structure attached to its upright section at the point of the common height, and with the top loading structure sloping up as it extends away from the other conductors, and all the top loading structures having a common length.

9. The antenna of claim 8 wherein the antenna is installed with the ground plane with a diameter in the range of between 0.50 and 1.0 wavelengths of the frequency for which the antenna is used.

10. The antenna of claim 8 further including an impedance matching section connected to each conductor to match the antenna to an active radio frequency signal device.

11. The antenna of claim 8 further including an impedance matching section connected to each conductor to match the antenna to an active radio frequency signal device to which all the antenna conductors are connected in parallel.

12. The antenna of claim 11 further including a signal converter connected to all the conductors to provide separate power signal paths for each conductor.

13. The antenna of claim 8 wherein the common height is in the range of between 0.001 and 0.25 wavelengths of the frequency for which the antenna is used.

14. The antenna of claim 11 wherein the common length is in the range of between 0.15 and 0.30 wavelengths of the frequency for which the antenna is used.

15. The antenna of claim 11 wherein the remote ends of the conductors are at a height above the ground plane in the range of between 0.001 and 0.25 wavelengths of the frequency for which the antenna is used.

* * * * *